United States Patent [19]

Jetter

[11] 4,352,170

[45] Sep. 28, 1982

[54] ALARM DEACTIVATION SYSTEM EMPLOYING TIMED MANUAL SWITCH OPERATION

[76] Inventor: Milton W. Jetter, 301 G St., SW., Washington, D.C. 20024

[21] Appl. No.: 218,519

[22] Filed: Dec. 22, 1980

[51] Int. Cl.[3] ..... G04C 21/00

[52] U.S. Cl. ..... 368/73; 368/262

[58] Field of Search ..... 368/72, 73, 244, 257, 368/262, 94

[56] References Cited

U.S. PATENT DOCUMENTS 3,797,223 3/1974 Oliveri ..... 368/262

4,246,651 1/1981 Komatsu et al. ..... 368/73

*Primary Examiner*—Bernard Roskoski

*Attorney, Agent, or Firm*—Herman L. Gordon

[57] ABSTRACT

An alarm clock with a local alarm system including a movement-operated switch, a relay with normally closed contacts, and an audible alarm device connected to the power lines through the movement-operated switch and said relay contacts. Said relay is energized by a circuit including a switch closed by lifting an operating knob, or in an alternative form, by lifting the entire clock. The system includes time delay relay latching means to prevent immediately latching the alarm circuit open but requiring the user to maintain the lifting force for a predetermined delay period, sufficient to produce wakefulness of the user, after which the alarm circuit is latched open. A signal lamp shows the delay period to be in effect until the delay period has been completed, thereby requiring the user to manually maintain the lifting force until the lamp becomes extinguished.

7 Claims, 5 Drawing Figures

ALARM DEACTIVATION SYSTEM EMPLOYING TIMED MANUAL SWITCH OPERATION

FIELD OF THE INVENTION

This invention relates to alarm systems, and more particularly to an alarm clock system having a specially-arranged alarm-deactivating means.

BACKGROUND OF THE INVENTION

Alarm clocks have heretofore been provided with various types of deactivation mechanisms and devices for enabling a user to shut off the alarm after it has become activated. In the case of mechanical clocks, manually operated stop devices have been employed to turn off the alarm. With electrically operated clocks, switch devices or various types of combined mechanical and electrical alarm deactivation means have been employed. This turns out to be a serious disadvantage, since the alarm can be deactivated before the user is fully awake, and thus there is a great temptation to go back to sleep, since it takes a substantial period of time for an awakened person's brain to reach a fully functioning state.

Various types of quasi-remote-controlled alarm deactivation devices have been proposed, such as by verbal command, by the use of bed switches controlled by the sleeper's weight, by photoelectric systems, by touch control, and the like. Most of these deactivation devices have proved to be unsatisfactory as being excessively complicated, unreliable in operation, too expensive, and not effective to adequately awaken the user. Thus, these previously proposed devices do not require a sufficient amount of physical or mental activity on the part of the user to enable him or her to become fully awake by the time the process of deactivating the alarm is completed. The time factor and the physical activity factor are quite important, since physical activity increases the blood circulation rate and assists the person's brain to reach a fully functional condition by the time the alarm is deactivated, especially when reaching such functional condition requires a substantial degree of concentration.

Therefore, a large percentage of prior clock alarm systems fail in their underlying purpose in that individuals learn to defeat these systems without being fully awake, and these individuals become accustomed to routinely going back to sleep after turning off the alarm. For this reason there is a definite need for an alarm deactivation system requiring a behavior pattern which ensures that the individual becomes fully awake by the time the alarm is completely deactivated.

A preliminary search of the prior art revealed the following prior U.S. Pat. Nos. of interest:

Newman, 2,239,160
Belich, 2,496,373
Dias, 3,005,919
Atkins et al, 3,081,594
Kleinerman, 3,320,739
McLeod et al, 3,498,047
Welty, 3,855,574
Scheer et al, 4,084,104
Yamazaki et al, 4,121,414

SUMMARY OF THE INVENTION

The alarm clock system of the present invention includes a clock with a local alarm system and with turn-off switch means requiring a special mode of operation, including substantial special physical activity and mental concentration. A typical arrangement according to the present invention involves the use of deactivation switch means which must be operated by the exertion of special upward vertical force by the user for an extended period of time, either by pulling upwardly on a normally depressed element projecting from the top of the clock, or in another embodiment, by manually lifting the clock vertically without appreciably tilting the clock, and in either case maintaining the upward force continuously for a preset period of time, sufficient to ensure full awakening of the user. The special benefit of the lifting action is that the user must exert greater muscular energy by lifting the arm or the entire clock in opposition to gravity. The turn-off switch means is incorporated in a timed switching circuit which can effectively deactivate the clock alarm only by maintaining the upward manual force for the predetermined time period, such as about 12 seconds, or for any other preset time period according to the user's required awakening time. The alarm switching circuit includes a lamp or other suitable visible indication device, which becomes energized at the start of the predetermined time period and automatically becomes deenergized at the end of said designated manual holding period, thus informing the user that the alarm has been latched in a deactivated condition and that he can then release his holding effort.

Accordingly, a main object of the invention is to overcome the deficiencies and disadvantages of the previously proposed clock alarm deactivation systems.

A further object of the present invention is to provide a novel and improved, relatively simple and reliable, electrical clock alarm control system which can be employed in a manner to require a user to exert a substantial amount of fairly careful physical effort to deactivate the clock alarm, and with mental concentration sufficient to ensure that the user reaches a wakeful state as a result of the deactivation procedure.

A still further object of the invention is to provide an improved clock alarm system which has an alarm deactivation circuit including a normally open switch which can be closed only by the exertion of substantial upward vertical force by the user, which must be maintained for a continuous substantial time period in order to latch the circuit in an alarm-deactivation state.

A still further object of the invention is to provide an improved clock alarm system which has an alarm deactivation circuit including control switch means and delay means for preventing effective deactivation of the clock alarm unless the control switch means is manually continuously activated for a predetermined length of time, which can be preset by the user, and which can be set to a length of time sufficient for the user to reach a wakeful state, and wherein the adjusted setting of the delay means cannot be disturbed during the alarm period.

A still further object of the invention is to provide an improved clock alarm deactivation system which uses relatively simple and inexpensive components, which is safe to use, and which requires the user to employ an alarm deactivation procedure of a type which will bring him effectively to a wakeful state by the conclusion of said procedure.

BRIEF DESCRIPTION OF THE DRAWINGS

Further objects and advantages of the invention will become apparent from the following description and claims, and from the accompanying drawings, wherein:

DETAILED DESCRIPTION OF PREFERRED EMBODIMENTS

Figure 1:
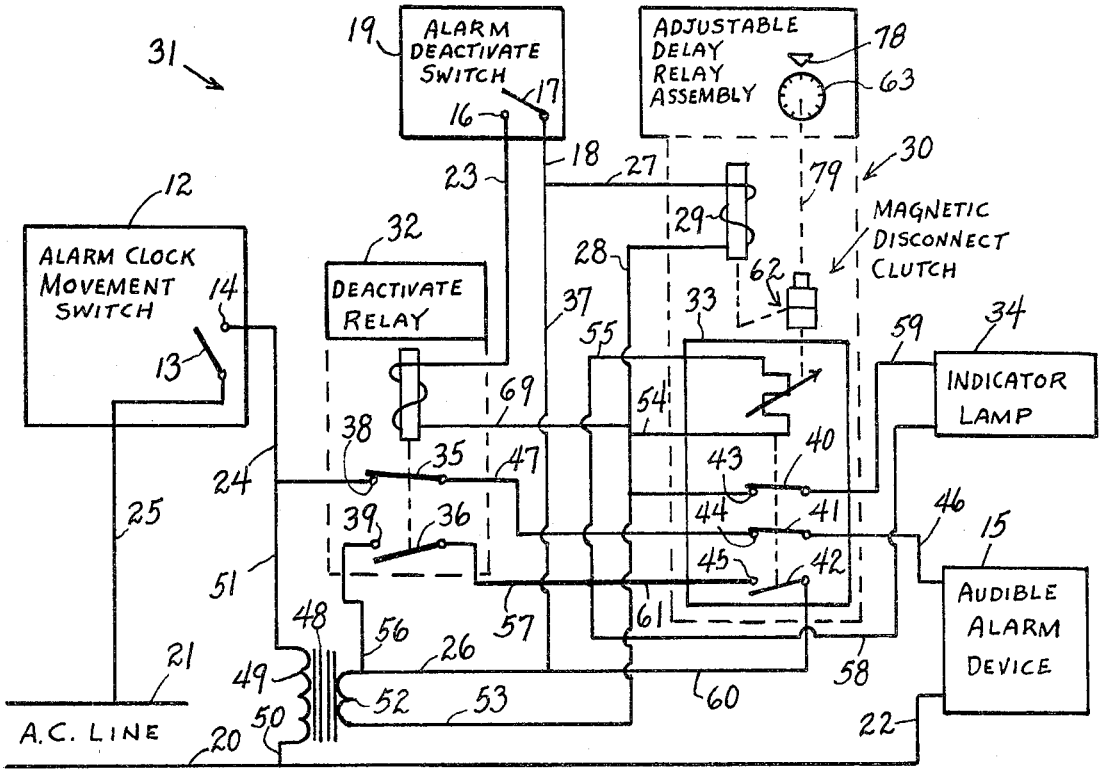
FIG. 1 is a schematic diagram illustrating a clock alarm deactivation system constructed in accordance with the present invention.

Referring to the drawings, FIG. 1 illustrates a typical clock alarm control system according to the present invention, generally designated at 31. The system 31 comprises a conventional alarm clock of the electrical type, provided with an alarm switch assembly 12 driven by the clock movement, said switch assembly including switch contacts 13, 14. The alarm clock can be set so as to close the contacts 13, 14 at a desired predetermined time. The system includes an electrically operated audible alarm device 15, an indicator lamp 34, an adjustable delay relay assembly 30, an alarm deactivate switch 19, and a deactivate relay 32. The system is suitably connected to power supply wires shown at 20, 21.

Figure 2:
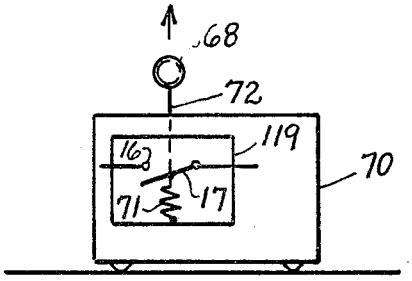
FIG. 2 is a generally schematic diagram illustrating one form of manual alarm deactivation switch arrangement which may be employed in the system of FIG. 1.

The deactivate switch 19 is a manually operated switch device of the single-pole, single-throw type, with inherent special operating requirements, designed to compel the user to exert an operational procedure which will bring him to a substantially awakened condition, and which may include both a specific physical procedure and a degree of mental concentration. The deactivate switch 19 may be designed to have various specific forms to meet these procedural conditions. Two such typical forms are illustrated in FIGS. 2 and 3, and are designated respectively at 119 and 219.

The generalized alarm deactivating switch 19 has the normally open switch contacts 16, 17, suitably biased to maintain them open. In the typical embodiment of FIG. 2, the alarm clock, shown at 70, includes the switch 119 which has a housing suitably secured in the clock, said housing containing the stationary contact 16 and the associated movable switch pole 17, biased downwardly by a spring 17 connecting said pole to the bottom of the switch housing. An operating rod 72, suitably secured to pole 17, extends vertically and slidably through the top walls of the switch housing and the clock housing and is provided on its top end with an operating knob 68. To hold the switch contacts 16, 17 closed, the user must continuously exert a substantial upward pulling force on the switch knob 68.

Figure 3:
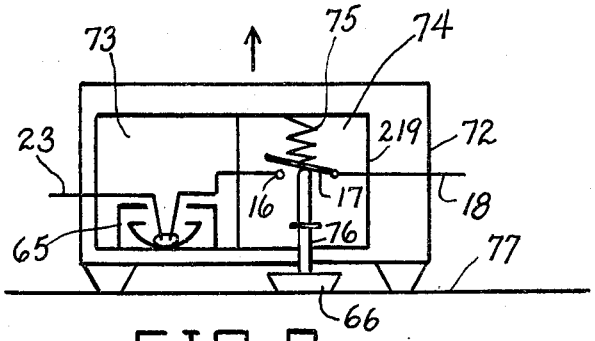
FIG. 3 is a generally schematic diagram illustrating another embodiment of an alarm deactivating manual switch arrangement which may be employed in the system of FIG. 1.

In the embodiment shown in FIG. 3, the switch 219 is contained in a suitable housing mounted in the associated clock, shown at 72, which may be of the small portable type, such as a travel clock. The switch 219 has two compartments, shown respectively at 73 and 74. Compartment 74 contains the stationary switch contact 16 and the associated pivoted pole 17, biased downwardly toward closing position by a spring 75 secured between pole 17 and the top wall of compartment 74. A vertical plunger rod 76 is slidably engaged through the bottom wall of compartment 74 and the bottom of the clock casing and has an enlarged rubber bottom pressure plate 66 normally engaging on the clock supporting surface 77. The top end of plunger rod 76 is suitably engaged with or connected to the pole 17 so as to hold it open while clock 72 is resting on the supporting surface 77. When the user raises the clock 72 bodily from its supporting surface 77 the switch contacts 16, 17 close. Mounted in compartment 73 is a tilt switch 65, which is normally closed and which may be of the conventional mercury type, such as is commonly used in portable heaters. The tilt switch 65 is connected in series with the contacts 16, 17, so that the associated circuit wires, shown at 23, 18 will be electrically connected together only if the clock 72 is carefully held level while it is in a lifted state.

Figure 4:
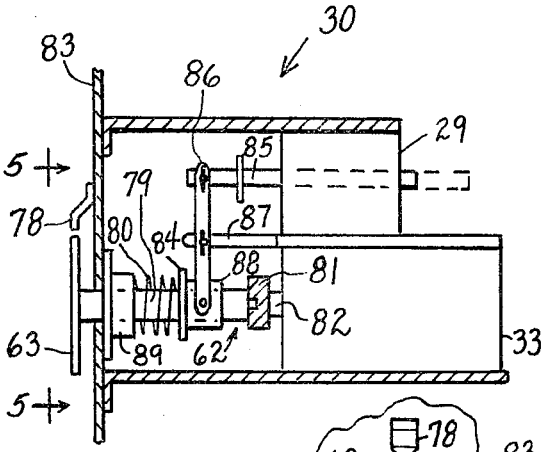
FIG. 4 is a longitudinal vertical cross-sectional view showing an adjustable time delay relay assembly which may be employed in the alarm deactivating system of FIG. 1.
Figure 5:
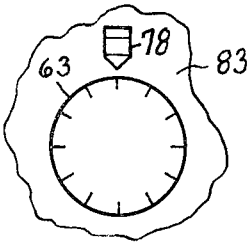
FIG. 5 is a fragmentary elevational view taken substantially on the line 5—5 of FIG. 4.

The adjustable-delay relay assembly 30, shown in FIG. 4, is provided with a manually settable control dial 63 which can be set, relative to a fixed index marker 78, to a selected time delay from 3 to 15 seconds. The assembly 30 includes a magnetic disconnect clutch 62 comprising an axially movable keyed shaft 79, carrying the external adjusting dial 63, which is urged by a coiled spring 80 into keying engagement with a grooved head 81 on the end of the rotatable delay-adjusting shaft 82 of the adjustable-delay relay 33. Spring 80 bears between a fixed collar 89 secured to the front wall 83 of the assembly and an abutment flange 84 rigidly secured on shaft 79. The assembly 30 includes a solenoid 29 having a movable plunger 85 connected to the top end of a lever 86 pivoted at its intermediate portion to a stationary arm 87. The bottom end of lever 86 is pivotally connected to an abutment collar 88 slidably and rotatably mounted on shaft 79 adjacent flange 84. When solenoid 29 is activated it moves shaft 79 away from grooved head 81 and disengages said shaft from the relay delay-adjusting shaft 82. This prevents any changes in the delay adjustment of relay 33 while solenoid 29 is energized.

The adjustable time delay relay 33 may include the delay time adjustment features of a conventional A.C. variable time delay relay such as Cornell-Dubilier Adjustable Time Delay Relay, Type No. C9-010. Time delay relay 33 has respective poles 40, 41 and 42. Poles 40 and 41 normally engage respective contacts 43 and 44. The lower pole 42 is normally disengaged from its associated contact 45 but is engageable therewith when the time delay relay completes its energization delay period, at which time the upper poles 40 and 41 disengage from their respective associated stationary contacts 43, 44.

Time delay relay unit 33 is generally similar to and may be replaced by conventional solid-state relay timing circuits, such as those employing uni-junction transistors, or provided with SCR devices, shown for example on pages 320 and 321 of "G.E. Transistor Manual", 7th Edition, 1964, published by General Electric Co., Syracuse, New York. The delay relay assembly 33 may include suitable conventional internal rectifier circuit means to permit D.C. operation.

When the alarm contacts 13, 14 are closed by the action of the clock switching mechanism at the preset alarm time, the alarm circuit is closed and the audible alarm device 15 becomes energized. The alarm device 15 has one terminal connected to line wire 20 by wire 22, and its other terminal is connected to line wire 21 via a wire 46, normally closed time delay relay contacts 41, 44, a wire 47, normally closed deactivate relay contacts 35, 38, wire 24, movement switch contacts 13, 14, and wire 25. The alarm unit 15 thus becomes energized by the closure of movement switch contacts 13, 14 at the alarm time set for the clock.

A step-down transformer 48 has its primary winding 49 connected across wire 22 and wire 24 by wires 50 and 51. The secondary winding 52 has one terminal connected by wire 53 to one input terminal 54 of time delay relay unit 33. The remaining secondary terminal is connected to the other input terminal 55 of time delay relay unit 33 via a wire 56, normally open deactivate relay contacts 39, 36, and wire 57.

The indicator lamp 34 has one terminal connected to wire 57 via wire 58, and its remaining terminal is connected to wire 53 via a wire 59 and normally closed time delay relay contacts 40, 43.

Time delay relay 33 is provided with a "stick" circuit connected across wires 56 and 57 (and deactivate relay contacts 36, 39) comprising a wire 60, normally open time delay relay contacts 42, 45, and a wire 61.

In operation, alarm unit 15 becomes energized by the closure of movement-actuated switch contacts 13, 14, as above described. This also energizes transformer primary 49. Consequently, transformer secondary 52 is activated, energizing solenoid 29 via wires 28, 53 and wires 27, 37 and 26. The energized solenoid 29 holds the dial shaft 79 disengaged from the coupling head 81 of the time delay relay shaft 82 that adjusts the relay timing circuit. Once the alarm clock movement switch contacts 13 and 14 are closed, the delay time (3 to 15 seconds) set on dial 63 cannot be changed until that particular alarm clock cycle terminates (alarm clock movement switch contacts 13 and 14 are reopened). User experience will determine how much delay time to set on the delay time dial 63 concurrently with setting the alarm clock.

To deactivate the clock alarm 15, switch 19 must be activated (contacts 16, 17 closed). If the pull switch 119 is used (FIG. 2), the user must maintain sufficient pulling force on the switch knob 68 to hold the switch contacts closed for at least the duration of the delay time set on the time relay delay dial 63. The form of deactivate switch arrangement 219 shown in FIG. 3 is particularly suitable for use in lightweight alarm clocks and travel alarm clocks. In this embodiment, to deactivate the alarm the entire clock is lifted from its resting position and held substantially level for the duration of the time delay set on the time delay relay dial 63. Both deactivation procedures require a sufficient amount of discipline and mental concentration to ordinarily bring the user to a substantially fully awakened state, and to attenuate the user's inclination to go back to sleep.

During the deactivation process, as previously stated, deactivation switch contacts 16, 17 are kept in a closed condition. Closing the contacts 16, 17 energizes deactivate relay 32 via a circuit comprising transformer secondary winding 52, wire 26, wire 37, wire 18, switch contacts 16, 17, wire 23, the relay winding, wire 69 and wire 53. Activated relay 32 thereby opens contacts 35, 38 and closes contacts 36, 39. This stops the alarm device 15, and energizes the time delay relay unit 33 via a circuit comprising secondary winding 52, wire 56, deactivate relay contacts 39,36, wire 57, wire 55, the time delay relay operating circuit, wire 54, and wire 53. At the same time, indicating lamp 34 becomes energized via wire 56, contacts 36,39, wire 57, wire 58, the lamp filament, wire 59, closed relay contacts 40, 43, and wire 53.

The user must hold the alarm deactivate switch in a closed-contact condition for a designated time corresponding to the delay period of the time delay relay unit, for example, 12 seconds. At the end of this delay period, contacts 40,43 and 41,44 open and contacts 42,45 close. The closure of contacts 42,45 latches the relay unit 33 "on", since it shunts the deactivate relay contacts 36,39. Lamp 34 becomes extinguished by the opening of contacts 40,43, informing the user that the required deactivate switch holding period has been completed, thereby allowing him to release the pull knob 68 or set the lightweight clock down, depending upon which form of the deactivate switch 19 was in use. The audible alarm device 15 is latched silent by the opening of time delay relay contacts 44,41. The alarm device 15 is thus effectively deactivated even though the total period of closure of the clock movement-operated contacts 13, 14 has not been completed. When the clock movement reopens contacts 13, 14, primary winding 49 becomes deenergized, resetting time delay relay unit 33 to its normal deenergized condition and likewise deenergizing solenoid 29. When solenoid 29 is deenergized, the time delay adjustment keyed dial shaft 79 reengages the adjustable time delay relay shaft coupling head 81.

The time delay relay 33 is of a type which resets to its starting condition whenever its energization is interrupted, including before the completion of its latching time period, namely, before the end of the selected 12 seconds, or other selected delay period, required to latch it "on". Therefore, if the user releases the alarm deactivate switch 19 before such completion, the deactivate relay contacts 36, 39 open, causing the time delay relay 33 to reset. Thus, in order to latch the relay "on" the user must again operate the alarm deactivate switch 19 and start a new 12-second, or other selected, latching period, the alarm device 15 being turned off by the opening of the deactivate relay contacts 38,35 while the alarm deactivate switch is being operated.

The generalized switch 19 represents any switch arrangement wherein the contacts 16, 17 must be closed by the user's exertion of a positive upward force on at least a portion of the clock system. The specific embodiments of FIGS. 2 and 3 are disclosed merely by way of example.

Within the spirit of the present invention, the adjustable-delay relay assembly 30 may be employed in alarm deactivation systems using other types of alarm deactivating switch systems different from the generalized switch assembly 19, for example, key-controlled deactivating switches, Touch Tone switch systems, numerical sequence-controlled push button switch systems, and the like.

The delay time period adjustment range may be within any desired practical range, such as 2 to 15 seconds, or any other range found desirable or necessary.

While certain specific embodiments of clock alarm deactivation systems have been disclosed in the foregoing description, it will be understood that various modifications within the scope of the invention may occur to those skilled in the art. Therefore it is intended that adaptations and modifications should and are intended to be comprehended within the meaning and range of equivalents of the disclosed embodiments.

What is claimed is:

1. In an alarm clock system, alarm sounding means, movement-actuated switch means, alarm circuit means to normally energize the alarm sounding means responsive to operation of said movement-actuated switch means, normally-open alarm deactivate switch means in the clock, circuit means including the deactivate switch means to immediately open and to hold said alarm circuit means open responsive to the initial and continued operation of said alarm deactivate switch means, whereby said alarm sounding means is immediately deenergized, means to operate said alarm deactivate switch means responsive to the manual exertion of positive upward force by the user on at least a portion of the clock, and means to latch the alarm sounding means in a deenergized state responsive to the continuous exertion of said positive manual upward force for a predetermined period of time, visible indicating means, means to energize said visible indicating means continuously during said predetermined period of time, and means to deenergize said indicating means and remove its indication at the termination of said period to inform the user that said positive upward force can be discontinued.

2. The alarm clock system of claim 1, and wherein said alarm deactivate switch means comprises a stationary contact in the clock, a movable pole below said stationary contact and being upwardly movable to engage the stationary contact, an upwardly extending actuator connected to said pole, and means to pull the actuator upwardly to move the pole into engagement with said stationary contact.

3. The alarm clock system of claim 1, and wherein said alarm deactivate switch means comprises a stationary contact in the clock, a movable pole mounted in the clock adjacent to the stationary contact, means biasing the pole toward engagement with the contact, and abutment means movably mounted in the clock, operatively coupled with the pole and normally engaging the supporting surface below the clock in the rest position of the clock to hold the pole disengaged from the contact against the force of said biasing means, said pole being engageable with the contact when the clock is lifted from the supporting surface.

4. The alarm clock system of claim 3, and normally closed tilt switch means in the clock electrically connected in series with said pole and stationary contact so as to open-circuit said means to hold the alarm circuit means open if the clock is tilted substantially while lifted.

5. In an alarm clock system, alarm sounding means, movement-actuated switch means, alarm circuit means to normally energize the alarm sounding means responsive to operation of said movement-actuated switch means, normally-open alarm deactivate switch means in the clock, circuit means including the deactivate switch means to immediately open and to hold said alarm circuit means open responsive to the initial and continued operation of said alarm deactivate switch means, whereby said alarm sounding means is immediately deenergized, means to operate said alarm deactivate switch means responsive to the manual exertion of positive upward force by the user on at least a portion of the clock, and means to latch the alarm sounding means in a deenergized state responsive to the continuous exertion of said positive manual upward force for a predetermined period of time, visible indicating means, means to energize said visible indicating means continuously during said predetermined period of time, and means to deenergize said indicating means and remove its indication at the termination of said period to inform the user that said positive upward force can be discontinued, wherein the means to hold the alarm circuit means open comprises deactivate relay means with normally closed contacts included in said alarm circuit means, and means to energize said deactivate relay means responsive to operation of said alarm deactivate switch means, wherein said latching means comprises delay relay means having normally closed contacts forming part of said alarm circuit means, means to open said last-named contacts at the termination of said predetermined period, means to energize said delay relay means concurrently with the initial energization of said deactivate relay means, and means to latch the delay relay means in an energized state at the termination of said predetermined period.

6. The alarm clock system of claim 5, and wherein said delay relay means is provided with means to adjust the length of said predetermined period.

7. The alarm clock system of claim 6, and means to disconnect said adjusting means responsive to operation of said movement-actuated switch means.

* * * * *